US011408040B2

(12) United States Patent
Manhart et al.

(10) Patent No.: US 11,408,040 B2
(45) Date of Patent: Aug. 9, 2022

(54) GAS PURGING PLUG, GAS PURGING SYSTEM, METHOD FOR CHARACTERIZATION OF A GAS PURGING PLUG AND METHOD FOR PURGING A METAL MELT

(71) Applicant: Refractory Intellectual Property GmbH & Co. KG, Vienna (AT)

(72) Inventors: Christian Manhart, Bruck a.d. Mur (AT); Matthäus Haider, Vienna (AT); Bernd Trummer, Graz (AT); Peter Pacher, Leoben (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 0 days.

(21) Appl. No.: 16/770,584

(22) PCT Filed: Jan. 28, 2019

(86) PCT No.: PCT/EP2019/051945
§ 371 (c)(1),
(2) Date: Jun. 5, 2020

(87) PCT Pub. No.: WO2019/145522
PCT Pub. Date: Aug. 1, 2019

(65) Prior Publication Data

US 2021/0164065 A1 Jun. 3, 2021

(30) Foreign Application Priority Data

Jan. 29, 2018 (EP) ..... 18153905

(51) Int. Cl.
*C21C 5/48* (2006.01)
*F27D 3/16* (2006.01)
*C21C 7/072* (2006.01)

(52) U.S. Cl.
CPC ..... *C21C 5/48* (2013.01); *C21C 7/072* (2013.01); *F27D 3/16* (2013.01); *F27D 2003/161* (2013.01); *F27D 2003/167* (2013.01)

(58) Field of Classification Search
None
See application file for complete search history.

(56) References Cited

U.S. PATENT DOCUMENTS 6,264,716 B1 * 7/2001 Kemeny ..... F27D 19/00 75/10.13
7,780,906 B2 * 8/2010 Burty ..... F27D 21/00 266/81

(Continued)

FOREIGN PATENT DOCUMENTS

AT 507069 A4 2/2010
CN 103160650 A 6/2013

(Continued)

OTHER PUBLICATIONS

"International Search Report for PCT Patent Application No. PCT/EP2019/051945" dated Mar. 6, 2019, 4 Pages.

(Continued)

*Primary Examiner* — Scott R Kastler
(74) *Attorney, Agent, or Firm* — Calfee, Halter & Griswold LLP

(57) ABSTRACT

Various embodiments provide for a gas purging plug (10) with a ceramic refractory body (10k) with a first end (10u) and a second end (10o); the second end (10o) is in the mounted position of the gas purging plug (10) in contact with a metal melt (41); the first end (10u) is at least partially covered with a metal cover (12.1), the metal cover (12.1) comprises an opening (16) to which optionally a gas supply adapter (20) is connected; the gas purging plug (10) is designed in such a way, that a purging gas which is supplied via the gas supply pipe (30) to the opening (16) flows (Continued)

Figure 1:
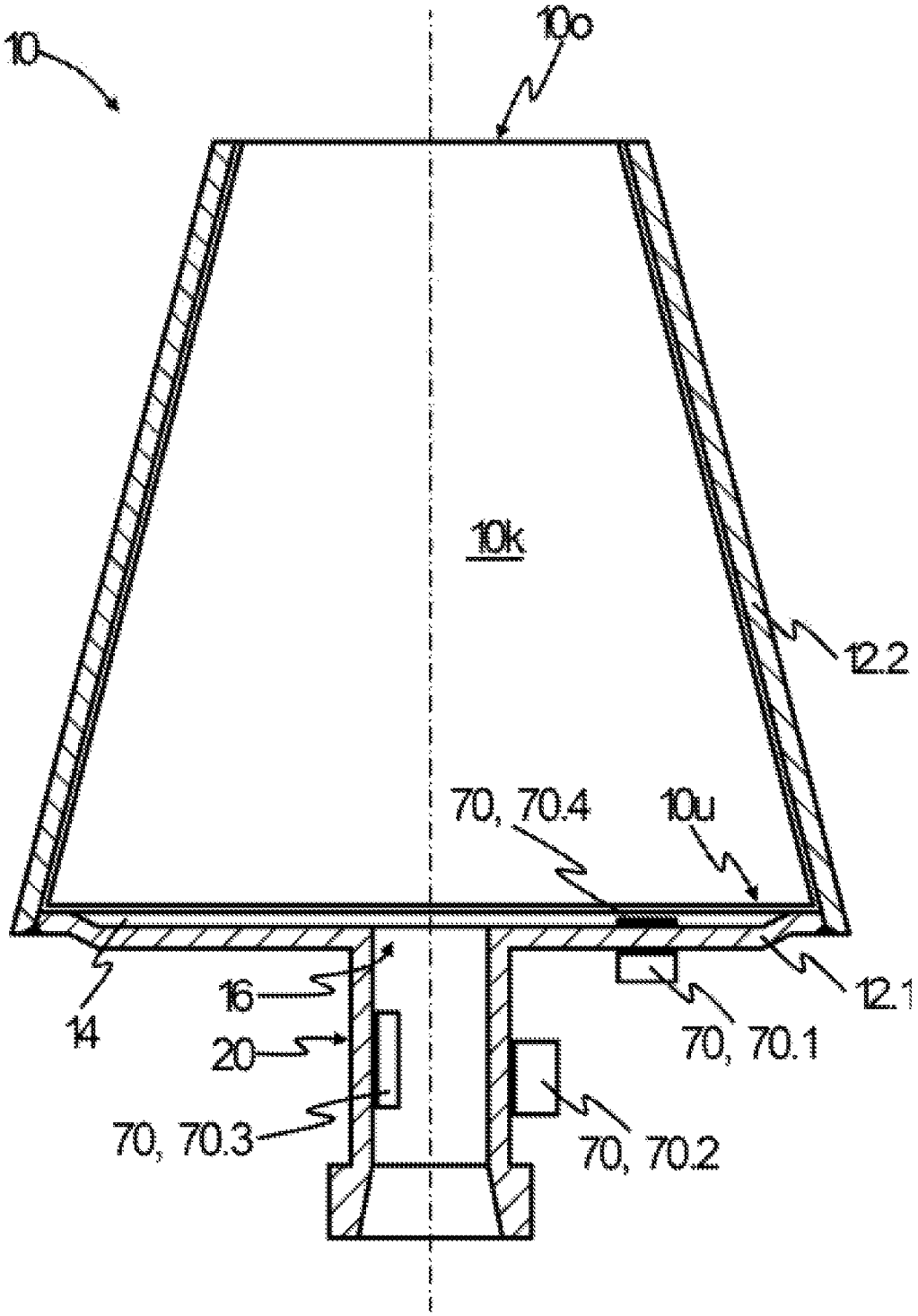

through the body (10k) and exits the body (10k) at the second end (10o); and wherein at least one electronic sensor (70, 70.1, 70.2, 70.3, 70.4) is in contact with the gas purging plug (10), to detect a mechanical vibration (81).

14 Claims, 4 Drawing Sheets

(56) References Cited

U.S. PATENT DOCUMENTS

| | | | | |
|---|---|---|---|---|
| 2006/0188692 | A1* | 8/2006 | Drescher ..... | B22D 1/005 428/131 |
| 2008/0047396 | A1 | 2/2008 | Burty et al. | |
| 2012/0000315 | A1 | 1/2012 | Fleischanderl et al. | |
| 2016/0209117 | A1 | 7/2016 | Zivanovic et al. | |
| 2016/0290722 | A1 | 10/2016 | Trummer et al. | |

FOREIGN PATENT DOCUMENTS

| | | | |
|---|---|---|---|
| CN | 104073601 | A | 10/2014 |
| DE | 3815663 | A1 | 11/1989 |
| DE | 10305232 | B3 | 8/2004 |
| DE | 102013208079 | A1 | 8/2014 |
| DE | 102013016156 | A1 | 4/2015 |
| EP | 2942406 | A1 | 11/2015 |
| KR | 20030054638 | A | 7/2003 |
| RU | 2378389 | C2 | 1/2010 |
| WO | 2019145522 | A1 | 8/2019 |

OTHER PUBLICATIONS

"Written Opinion of the International Searching Authority for PCT Patent Application No. PCT/EP2019/051945", dated Mar. 6, 2019, 6 Pages.

"The First Office Action for Chinese Patent Application No. 201980010297.0", dated Apr. 22, 2021, 7 pages.

"Office Action for Chinese Patent Application No. 201980010297.0", dated Dec. 3, 2021, 7 pages.

"Office Action for Canadian Patent Application No. 3,087,825", dated Jul. 13, 2021, 5 pages.

"Office Action for Canadian Patent Application No. 3,087,825", dated Jan. 20, 2022, 3 pages.

"Response to the Office Action for Canadian Patent Application No. 3,087,825", Filed Date: Nov. 5, 2021, 20 pages.

INTECO, "Gas Coupling Systems", Process Technology International, 7 pages.

MTUS Technology, "Automatic Ladle Gas Coupling System: Rapid, Secure Connections for the Gas Bubbling/Purging Process", 2 pages.

Beda Oxygentechnik, "Systems for Ladle Stirring", Retrieved Date: Nov. 2, 2021, Retrieved At: <<https://beda.com/en/products/systems-for-ladle-stirring>>, 2 pages.

"Office Action for Russian Patent Application No. 2020128675/05", dated 2021, 11 pages.

"Office Action for Ukraine Patent Application No. a 2020 03660", dated Apr. 13, 2022, 9 pages.

"Office Action for Indian Patent Application No. 202017032537", dated Mar. 14, 2022, 7 pages.

* cited by examiner

GAS PURGING PLUG, GAS PURGING SYSTEM, METHOD FOR CHARACTERIZATION OF A GAS PURGING PLUG AND METHOD FOR PURGING A METAL MELT

The invention relates to a gas purging plug, a gas purging system for treatment of a metal melt, a method for characterization of a gas purging plug and a method for purging a metal melt with an electronic sensor for the detection of an oscillation of a mechanical vibration.

A gas purging element, also called gas purging plug, is used for the introduction of gases or, if applicable also gas/solid mixtures, into a melt which is to be treated, especially a metal melt metallurgical melt. During the purging process the gaseous treatment fluid is led along corresponding channels/slits in a gas purging plug with directed porosity or along a corresponding irregular pore volume in a gas purging plug with random porosity.

Such a gas purging plug generally comprises a ceramic refractory (fireproof) body with a first and second end, the second end is in the mounted position of the gas purging plug in contact with a metal melt, the first end is covered with a metal cover, which comprises an opening. The gas purging plug is designed in such a way, that a treatment gas, supplied/entering via the opening of the metal cover, flows through the body and exits the body at the second end. Such a gas purging plug can be installed in various types of metallurgical vessels, such as a ladle, a converter etc. where it is used to introduce a gas into a metal melt, e.g. in order to facilitate a movement of the melt (also called stirring) or to induce metallurgical reactions. One exemplary effect of the introduction of inert gases into a metal melt is the improvement of the degree of purity of the steel (steel cleanliness), due to a transport of non-metallic contaminations to the slag and due to a reduction of gases (see e.g. "Einsatz and Verschleiß von Spülsteinen in der Sekundärmetallurgie", Bernd Grabner, Hans Höffgen, Radex-Rundschau, Heft 3, 1983, page 179ff).

Exemplary purging plugs are disclosed in EP 1 101 825 A1 or EP 2 703 761 B1. US 2008/0047396 A1 discloses a method which consists in introducing a stirring gas through the vessel bottom, in receiving a measurable mechanical vibration by at least one sensor fixed to the vessel or to the supporting frame thereof, in filtering the thus detected vibration signals by several filters, in sequencing said responses, in exposing each sequence to the calculation of a temporal moving mean square, in extracting the total effective value RMS (for 'Root Mean Square') of the measured vibration signal therefrom, wherein said effective value is used for controlling the stirring gas flowrate supplied to the vessel. U.S. Pat. No. 6,264,716 B1 discloses a process for stirring molten steel in a container, where argon gas is introduced into the container, the extent to which said container is caused to vibrate is measured, analog signals are produced corresponding to the rate of flow of argon gas into said container, the analog signals are sampled and converted to digital signals, the digital signals are transformed by subjecting them to fast Fourier transformation, and the transformed digital signals are evaluated.

The inventors have realized, that for an efficient purging of a metal melt, especially with respect to the removal of non-metallic impurities, it is important to know and to control the distribution (e.g. amount and size) of the gas bubbles introduced by the purging plug. For different gas volume flows through the gas purging plug, different gas bubble distributions will be reached. Due to wear of the purging plug, the distribution of gas bubbles introduced into a melt can vary over time, even at a constant gas volume flow. Different gas bubble distributions can lead to different results during purging of a metal melt, especially with respect to the removal of impurities. Also different purging plugs can have a variance in their gas bubble distribution due to production variances. In order to document the quality of the produced steel, it is desirable to document the parameters of purging a metal melt, especially with respect to the removal of impurities. It is also desirable to be able to reproduce a certain gas bubble distribution to achieve constant quality in the production of steel.

Therefore it is an object of the invention to provide a gas purging plug, a gas purging system for treatment of a metal melt, a method for characterization of a gas purging plug and a method for purging a metal melt, which allows an improved production reliability during the production of steel, especially during the purging treatment of steel.

It is another object of the invention to provide a gas purging plug, a gas purging system for treatment of a metal melt, a method for characterization of a gas purging plug and a method for purging a metal melt, which allows a reproducible treatment of a metal melt with a gas.

The object is achieved according to the invention by a gas purging plug, a gas purging system for treatment of a metal melt, a method for characterization of a gas purging plug, and a method for purging a metal melt as described herein. The advantages and refinements mentioned in connection with the method also apply analogously to the products/physical objects and vice versa.

The core idea of the invention is based on the finding, that the structure-borne vibrations (mechanical vibrations/oscillations) produced by the bubbles exiting the body of the purging plug at its second end can be measured by an electronic sensor in contact with the gas purging plug. This allows to detect and analyze the gas bubble distribution of a gas introduced into a metal melt.

In the following "oscillation waveform of a mechanical vibration" is understood as the time profile of a detected oscillation resulting from a mechanical vibration. Mathematically speaking, this is a function g(t) of time t, or its discrete values at specific times $g(t_i)$. The values g(t) can for example be acceleration values, or proportional to an energy or simply a deflection (such as a displacement). In the following, a "frequency spectrum" is understood as the representation of the oscillation waveform of a mechanical vibration in a specific time interval in the frequency domain. These are, therefore, coefficients (the frequency amplitude values) of the oscillations from which the oscillation waveform of a mechanical vibration is composed in a specific time interval. The frequency amplitude values $G(f_j)$ of the respective frequency components are obtained as a function of the frequency $f_j$, or their temporal progression $(G(t,f_j))$.

In the following "volume flow" denotes the volumetric flow rate of a gas (also often called gas volume flow) Q, which is the flow of volume V through a surface (e.g., the cross sectional area of the gas supply pipe) per unit time t (measured in $m^3/s$ or l/s or l/min; 1 l/min=$1.6\times10^{-5}$ $m^3/s$).

In a first embodiment of the invention, the object is achieved by providing a gas purging plug for metallurgic applications comprising a.) a ceramic refractory body with a first end and a second end;

b.) the second end is in the mounted position of the gas purging plug in contact with a metal melt;

c.) the first end is covered (at least partially) with a metal cover, the metal cover comprises an opening to which optionally a gas supply adapter is connected;

d.) the gas purging plug is designed in such a way, that a purging (treatment) gas, which is supplied via the opening, flows through the body and exits the body at the second end;

e.) and at least one electronic sensor in (mechanical) contact with the gas purging plug (e.g. that can be mounted on the metal cover or the gas supply adapter), to detect an oscillation waveform of a mechanical vibration, whereas the electronic sensor is an acceleration sensor.

In a second embodiment the invention relates to a gas purging system comprising a gas purging plug for metallurgic applications and a gas supply pipe connected to the gas purging plug (via the opening or via the gas supply adapter), the gas purging plug comprising:

a.) a ceramic refractory body with a first end and a second end;

b.) the second end is in the mounted position of the gas purging plug in contact with a metal melt;

c.) the first end is (at least partially) covered with a metal cover, the metal cover comprises an opening to which optionally a gas supply adapter is connected;

d.) the gas purging plug is designed in such a way, that a purging (treatment) gas which is supplied via the gas supply pipe to the opening flows through the body and exits the body at the second end;

e.) and at least one electronic sensor in (mechanical) contact with the gas purging plug (e.g. that can be mounted on the metal cover or the gas supply adapter), to detect an oscillation waveform of a mechanical vibration, whereas the electronic sensor is an acceleration sensor; the gas purging system further comprises:

f.) a data processing unit for acquiring the oscillation waveform of a mechanical vibration detected by the electronic sensor of the gas purging plug and for calculating a bubble index signal from the oscillation waveform of a mechanical vibration detected;

g.) a control unit; wherein the control unit is configured to:

displaying the bubble index signal; and/or varying the volume flow through the gas supply pipe depending on the bubble index signal; and/or generating a warning signal when the bubble index signal lies outside a defined range.

The ceramic refractory body may be a porous refractory material (indirect porosity) or a dense material with channels/slits (direct porosity) or a mixture thereof (indirect and direct porosity). The ceramic body can have various shapes, such as a truncated cone, a cylinder, a frustum of pyramid, a cuboid or the like.

In a mounted position the purging plug may be positioned in the wall of a metallurgical vessel, such that its second end (upper end or "inner" end) comes into contact with a metal melt filled into the metallurgical vessel. The first end (lower end or "outer" end) of the body of the purging plug can be at least partially covered with a metal cover which comprises an opening. The first end (lower end) of the body of the purging plug can be fully or partially covered with a metal cover which comprises an opening.

The opening may be a simple opening (e.g. a hole) or, optionally, the opening can be connected to a gas supply adapter. The gas supply adapter allows simplified mounting and demounting of the gas supply pipe. Preferably the gas supply adapter is connected rigidly (irreversibly) to the metal cover of the purging plug, e.g. by means of welding together the gas supply adapter and the metal cover. The gas supply adapter can form an integral and inseparable part of the metal cover.

The purging plug may be designed in a way, that when a purging (treatment) gas is supplied via the opening (or via the optional gas supply adapter), the purging (treatment) gas will flow through the body of the purging plug and exit the body at its second end, where the purging (treatment) gas will enter into the metal melt. At the interface between the second end of the purging plug and the metal melt, gas bubbles of different sizes and at different rates will form, depending on the microstructure of the body and depending on the gas volume flow. After a gas bubble emerges at this interface at a certain moment the gas bubble will detach from the second end of the body and migrate fully into the metal melt. Each of such a gas bubble migration induces an impulse to the body. All of these impulses travel to the first end and to the metal cover of the body. The repetition (frequency) of such impulses relates to the bubble sizes, as small bubbles migrate at a high repetition rate (high frequency) while large bubbles have a longer residence time at the interface and thus a low repetition rate (low frequency). The intensity of such impulses at a certain repetition rate (frequency) relates to the number (quantity) of bubbles of a certain size leaving the body.

The transmitted impulses may be measured as a mechanical vibration/oscillation. Therefore, the purging plug further comprises at least one electronic sensor in (mechanical) contact with the gas purging plug to detect an oscillation of a mechanical vibration, which emerges from gas bubbles leaving the body into the metal melt. The electronic sensor allows to acquire/to detect an oscillation waveform of a mechanical vibration. The electronic sensor is in direct contact with the purging plug, such that a structure borne vibration induced by bubbles leaving the body of the purging plug can be detected. The direct contact with the gas purging plug allows to acquire the oscillation waveform of a mechanical vibration generated by the bubbles emerging from the second end at a very high quality (high level signal), with a very small influence from any vibrations induced in any other part of the metallurgical vessel.

The at least one electronic sensor may be mounted on the metal cover or the gas supply adapter, to detect an oscillation waveform of a mechanical vibration.

The at least one electronic sensor may be in contact with the gas purging plug by being mounted on the metal cover or outside the gas supply adapter or inside the gas supply adapter. These positions allow an excellent detection of an oscillation waveform of a mechanical vibration originating from the gas bubbles entering the metal melt. The mounting position on the metal cover includes mounting the sensor on either side of the metal cover, or in other words on the side of the metal cover facing the body or on the side of the metal cover in the outside direction (that is on its outside face). The mounting position on the metal cover in the outside direction or outside the gas supply adapter allow good accessibility and servicing of the sensor. Preferably the electronic sensor is mounted inside the gas supply adapter or on the side of the metal cover facing the body. The mounting position inside the gas supply adapter or on the side of the metal cover facing the body gives a good protection of the sensor e.g. against mechanical impacts. The sensor may preferably be an oscillation/acceleration sensor.

The sensor may preferably be an oscillation/acceleration sensor selected from the group consisting of: laser vibrometer, piezoelectric accelerometer, piezo-resistive sensor, strain gauges, capacitive acceleration sensor, magneto-resistive acceleration sensor. By using one of these acceleration sensors, sound influences from the environment (such as secondary noises; e.g. from the metallurgical vessel) may be largely excluded.

Conventional sound sensors, such as microphones, are disadvantageous or even unsuitable, since many background noises are picked up from the environment. The electronic sensor of the gas purging plug may be an acceleration sensor, preferably a piezoelectric acceleration sensor. By using a piezoelectric acceleration sensor, environmental influences (such as secondary noises) may be largely excluded and, at the same time, high reproducibility and longevity of the purging plug may be achieved.

The sensor detects the oscillation waveform of a mechanical vibration which is produced by bubbles leaving the purging plug at the second end, i.e. the structure-borne vibrations emerging from the leaving bubbles. This is done according to the principle of acceleration measurement. In particular, the deflections of an oscillation of a mechanical vibration in the direction along the axis of the purging plug are recorded. The sensor therefore generally provides acceleration values, which are normal to the surface of the second end of the body in the form of a sequence of electrical values (power or potential) as a function of the time.

Therefore, preferably the sensor may be configured to detect oscillations/accelerations of a mechanical vibration in a direction normal to the area defined by the second end of the body. Such a sensor may exhibit a so called transverse sensitivity of ≤5% or preferably even ≤3%. Such a sensor configuration greatly reduces background noise from other sources.

The acceleration values may for example be sampled to form an oscillation waveform of a mechanical vibration g consisting of discrete values ($g(t_0)$, $g(t_1)$, $g(t_2)$ . . . values: electrical current or voltage/potential which are proportional to an acceleration) as a function of discrete time values $t_0$, $t_1$, $t_2$ and then further analyzed in a data processing unit.

In a further aspect, the sensor may be integrated into a clamp which surrounds the gas supply adapter. This allows easy interchangeability of the sensor.

The gas purging system may further comprise a data processing unit for acquiring/recording the oscillation waveform of a mechanical vibration by the sensor.

The gas purging system may further comprise a control unit.

A data processing unit, a control unit are understood to mean one or more devices for carrying out the respective method steps described below, and which, for this purpose, comprise either discrete electronic components in order to process signals, or which are implemented partially or completely as a computer program in a computer.

For example, the control unit and the data processing unit can be connected, such that the data processing unit and the control unit can exchange data. The control unit can be part of the data processing unit or vice versa. The control unit and the data processing unit can be implemented by a software into a computer.

The data processing unit may be connected to the electronic sensor of the gas purging plug and can carry out the following method steps:

The signals of the sensor (oscillation waveform of a mechanical vibration) may be continuously monitored (also acquired and processed) and these signals may be converted into a frequency spectrum (frequency amplitudes). Acquisition of the oscillation waveform of a mechanical vibration is preferably done by electronic means, e.g. by digitizing the electrical signals from the sensor and subsequently digitally storing the digitized data on a data carrier or in the memory of a computer. The conversion (transformation) of the oscillation waveform of a mechanical vibration into frequency amplitudes, i.e. the calculation of a frequency spectrum (frequency transformation), may be done, for example, through Fourier transformation or a Fast Fourier transformation.

The frequency spectrum may be calculated from the oscillation waveform of a mechanical vibration of a particular time interval. The time interval is in the range of 10 milliseconds to 5 seconds.

The reference frequency spectrum may be recorded and calculated in advance (e.g. at a time t=0 or alternatively upon production of the purging plug) from a detected oscillation waveform of a mechanical vibration. The oscillation waveform of a mechanical vibration is referred to as a "reference signal" in the case it relates to a reference purging plug or in case it relates to an oscillation waveform of a mechanical vibration acquired in a reference measurement; in this case the frequency spectrum is referred to as the "reference frequency spectrum".

The actual frequency spectrum may be calculated in real-time (during operation) from a detected oscillation waveform of a mechanical vibration. In this case, the oscillation waveform of a mechanical vibration is referred to as the "actual signal". In this case, the frequency spectrum is referred to as the "actual frequency spectrum".

The oscillation waveform of a mechanical vibration g ($g(t_0)$, $g(t_1)$, $g(t_2)$ . . . values: electrical current or voltage/potential) as a function of discrete time values $t_0$, $t_1$, $t_2$ of the sensor may be converted through transformation into frequency amplitude values G as a function of discrete frequencies $f_j$. The transformation (FT for frequency transformation) is applied to a specific time interval (e.g. at the times $t_i$, where $i=i_0 \ldots i_1$), wherein a frequency spectrum is obtained at time $t=t_{i1}(G(t_{i1}, f_j))$.

$$G(t_{i1}, f_j)=FT(g(t_{i0}), \ldots, g(t_{i1}))$$

The frequency transformation FT is preferably a transformation which calculates a power spectrum from the harmonic oscillations of a signal function f (harmonic power in a signal), i.e.:

$$FT(f)=X(f)X^*(f)=|X(f)|^2$$

wherein $X(f)=FFT(f)=FFT(g(t_{i0}), \ldots, g(t_{i1}))$ is the so-called FastFourier transformation and $X^*(f)$ is the complex conjugation of X(f).

From the (reference and actual) frequency spectra obtained in that way, the bubble index component $BI_n$ may be calculated by summing the frequency amplitude values G(t,f) over a defined frequency range ($BI_n=\overline{G}_n(t)=\Sigma_{j=a}^{b}G(t, f_j)$). In particular, at least one bubble index component is determined from the actual frequency spectrum (e.g. an actual bubble index component $BI_n(t)$) and/or at least one bubble index reference component (e.g. $BI_n(0)$) is determined from the reference frequency spectrum by summing the respective frequency amplitude values G(t,f) over a specific frequency range.

Preferably, at least one bubble index component ($BI_n=\overline{G}_n(t)=\Sigma_{j=a}^{b}G(t, f_j)$), e.g. a first bubble index component $BI_1$, may be calculated in the range of $f_j$ from (a=) 20 Hz to (b=) 1000 Hz from the actual and target frequency spectra, respectively. This range was found to describe large sized bubbles.

Preferably, at least one bubble index component ($BI_n=\overline{G}_n(t)=\Sigma_{j=a}^{b}G(t, f_j)$), e.g. a second bubble index component $BI_2$, may be calculated in the range of $f_j$ from (a=) 1000 Hz to (b=) 6000 Hz from the actual and target frequency spectra, respectively. This range was found to describe medium sized bubbles.

Preferably, at least one bubble index component ($BI_n = \overline{G}_n(t) = \Sigma_{j=a}^{b} G(t, f_j)$), e.g. a third bubble index component $BI_3$, may be calculated in the range of $f_1$ from (a=) 6000 Hz to (b=) 8000 Hz from the actual and target frequency spectra, respectively. This range was found to describe small sized bubbles.

Optionally (additionally), the bubble index component may be calculated as a moving average (sliding mean) value for smoothing the signal $BI_n = \overline{G}_n(t)$. Thus, for example, with $$\overline{G}_n(t) = \frac{1}{m}\sum_{i=0}^{m-1}\sum_{j=a}^{b} G(t-i, f_j)).$$

The length of the time interval via which the moving average value may be calculated is selected based on the data quality. The calculation of the moving average value has the effect that short-term or high-frequency disturbances have no influence on the purging result. Optionally (additionally) at least one bubble index component can be calculated from the acceleration root mean square (accel. RMS), e.g. according to:

$$BI_n = accel.\text{RMS} = \sqrt{\frac{1}{t2-t1}\sum_{t1}^{t2} g(t)^2} \quad \text{or}$$

$$BI_n = accel.\text{RMS} = \sqrt{\sum_f |X(f)|^2}$$

The bubble index signal BI(t) may be calculated using a (weighted) summation of the deviations (differences) between at least one of or more of the actual and reference bubble index components.

This may be effected, for example, by a weighted linear summation and/or by square summation of the differences (deviations) of individual, or all, actual/reference bubble index components, respectively with weighting factors $a_n$:

$$BI(t) = a^{(0)} + \sum_{n=n0}^{n1} a_n^{(1)}(BI_n(t) - BI_n(0)) + \sum_{n=n0}^{n1} a_n^{(2)}(BI_n(t) - BI_n(0))^2$$

or, alternatively, also by quotient formation of actual and reference bubble index components and by linear summation and/or by square summation of the quotients of individual, or all, actual and reference bubble index quotients, in each case with weighting factors $a_n$:

$$BI(t) = a^{(0)} + \sum_{n=n0}^{n1} a_n^{(1)}(BI_n(t)/BI_n(0)) + \sum_{n=n0}^{n1} a_n^{(2)}(BI_n(t)/BI_n(0))^2$$

The weighting factors may be obtained either by empirical studies, by mathematical models from simulation calculations, or by computer-assisted learning (e.g. in the manner of a neural network).

The weighting factors may also be obtained by varying the volume flow through the gas purging plug and an optical inspection of the bubble distribution e.g. in a water bath model.

Respective actual and reference bubble index components may be determined in a similar way, e.g., using the same mathematical formula or algorithm. While the actual bubble index components $BI_n(t)$ are generally determined during operation, the reference bubble index component $BI_n(0)$ can be determined in advance, either directly after production of a gas purging plug or at the beginning of a purging operation in a reference run. Such a reference run can exemplarily be started when a hot metal melt is filled into a vessel equipped with a gas purging plug/system according to the invention. The bubble index reference components $BI_n(0)$ can be obtained for different values of the gas volume flow. The gas bubble reference components $BI_n(0)$ can be stored in the control unit or on any storage that can be made accessible from the control unit. Alternatively the reference bubble index components $BI_n(0)$ can also be determined from a computer simulation or the values may be defined by the operator in the sense of a target function.

Thus the data processing unit can determine the reference bubble index components $BI_n(0)$ by summing frequency amplitude values from the reference frequency spectrum over a defined frequency range.

The data processing unit may also determine the actual bubble index components $BI_n(t)$ by summing frequency amplitude values from the actual frequency spectrum over a defined frequency range.

The data processing unit may determine the bubble index signal BI(t) by a weighted summation of the differences or quotients between the actual bubble index components $BI_n(t)$ and the reference bubble index components $BI_n(0)$.

The control unit can may be further configured to display at least the bubble index signal BI(t), e.g. during operation of the plug.

The control unit may be configured to vary the volume flow Q through the gas supply pipe depending on the bubble index signal.

The control unit may be configured to generate a warning signal when the bubble index signal lies outside a defined range, e.g. if BI(t) exceeds a predefined limit value. The warning signal may be acoustic (emission of a sound), optical (e.g. by a warning lamp or a display on a screen). The warning signal may also be fed to a further control unit, in particular the warning signal may trigger an alert to replace the purging plug after operation with a new purging plug.

The control unit may further comprise a control valve to control the volume flow of the purging gas through the gas supply pipe. The control valve may be an electrically controllable valve, such as e.g. an electrically controllable needle-valve. The control unit may comprise a control valve and can be configured to varying the volume flow through the gas supply pipe depending on the bubble index signal.

The control unit may further comprise a flow meter to measure the volume flow of the purging gas supplied through the gas supply pipe. The flow meter can provide data regarding the volume flow of the purging gas that can be further processed in/by the control unit.

The control unit may optionally also comprise a pressure gauge to measure the pressure in the gas supply pipe. The pressure gauge may provide data regarding the pressure of the purging gas that can be further processed in/by the control unit.

In a another aspect of the invention, the object is achieved by providing a method for purging a metal melt in a metallurgical vessel with a gas, comprising the steps of:

Setting the actual volume flow of a gas through the purging plug to a pre-determined value of the initial volume flow;

Acquiring an oscillation waveform of a mechanical vibration at the actual volume flow by at least one electronic sensor in direct contact with the gas purging plug, whereas the electronic sensor is an acceleration sensor, preferably a piezoelectric acceleration sensor; and:

Variation of the volume flow through the gas supply pipe depending on the acquired oscillation waveform of a mechanical vibration; and/or Generating a warning signal depending on the acquired oscillation waveform of a mechanical vibration.

In a further aspect of the invention, the object is achieved by providing a method for purging a metal melt in a metallurgical vessel with a gas, comprising the following steps:

Setting the actual volume flow of a gas through the purging plug to a pre-determined value of the initial volume flow;

Calculating a bubble index signal from the acquired (measured) oscillation waveform of a mechanical vibration at an actual volume flow through the gas supply pipe; and further:

generating a warning signal if the bubble index signal lies outside a predefined bubble index range; and/or Variation of the volume flow through the gas supply pipe as a function of the bubble index signal.

The method preferably uses a gas purging plug according to the invention. The method preferably uses a gas purging system according to the invention. Preferably the method determines in a first step (that is before calculation of the bubble index signal BI(t)) predefined values for at least one of the values of the following group: a reference bubble index component $BI_n(0)$, an initial volume flow $Q_0$ through the gas supply pipe, a bubble index range ΔBI, a target/maximum gas volume $V_{MAX}$. These values may for example be loaded from the memory of a computer or entered by a user. In case of the reference bubble index component(s) $BI_n(0)$, the values may be supplied together with the gas purging plug, e.g. in the sense of an electronic data sheet. The values may be loaded into the data unit.

During the first step of the method the volume flow of the purging gas through the gas supply pipe can be set to the pre-defined value of the initial volume flow ($Q=Q_0$). Preferably the control unit can adjust the electrically controllable valve such that the initial volume flow is reached.

The step of variation of the volume flow may include increasing the volume Q(t) flow of the purging gas through the gas supply pipe (e.g. by the electronically controllable valve) in case the bubble index signal BI(t) lies within a predefined bubble index range ΔBI. The increase can be done by increasing the volume flow Q(t) by a discrete value of ΔQ, such that $Q(t+1)=Q(t)+\Delta Q$. Preferably the control unit can adjust the electrically controllable valve such that the new volume flow Q(t+1) is reached. This allows a very efficient purging with a very high purging rate (short time).

Alternatively, the step of variation of the volume flow may include keeping constant the volume flow Q(t) of the purging gas through the gas supply pipe in case the bubble index signal BI(t) lies within a predefined bubble index range ΔBI, such that $Q(t+1)=Q(t)$. This allows a very uniform and defined purging process over time.

The step of variation of the volume flow may include decreasing the volume flow Q(t) of the purging gas through the gas supply pipe (e.g. by the electronically controllable valve) in case the bubble index signal BI(t) lies outside a predefined bubble index range ΔBI. The decrease can be done by decreasing the volume flow Q(t) by a discrete vale of ΔQ, such that $Q(t+1)=Q(t)-\Delta Q$. Preferably the control unit can adjust the electrically controllable valve such that the new volume flow Q(t+1) is reached.

The step of variation of the volume flow may include an algorithm for searching the maximum possible volume flow exhibiting a certain pre-defined bubble index signal. Thereby it is possible to previously define a certain target bubble size distribution and the algorithm constantly optimizes gas volume flow in order to achieve the target bubble size distribution optimally.

The method may further comprises a step, where the gas purging is stopped, when the total volume flow of the purging gas $Q_{total}$ through the pipe reaches a predefined target gas volume ($V_{MAX}$), e.g. when $Q_{total} \geq V_{MAX}$. The total volume flow $Q_{total}$ is measured by the flow meter or calculated from the actual volume flow values, which are summed (or alternatively integrated) over time:

$$Q_{total}=\Sigma_t Q(t) \geq V_{MAX}$$

Preferably the control unit may stop the gas flow by adjusting the electrically controllable valve such that the volume flow of the purging gas is zero when the total volume flow $Q_{total}$ of the purging gas through the pipe reaches (or exceeds) a predefined target gas volume ($V_{MAX}$).

The method may be applied advantageously during operation of purging a metal melt in a metallurgical vessel.

Alternatively the method may be applied for the characterization of a gas purging plug. This can be done for example after production of the gas purging plug, e.g. in a water bath trial. This may also be done for example in a test trial. During characterization of such a gas purging plug, values for the reference bubble index components $BI_n(0)$ may be obtained and stored for different volume flows (Q(t)). In such a water bath trial different bubble index components can be related to real bubble sizes by optical means.

In a further aspect of the invention, the object is achieved by providing a method for characterization of a gas purging plug, comprising the following steps:

Setting an actual volume flow of a gas through the purging plug (e.g. to a pre-defined value of the initial volume flow);

Acquiring an oscillation waveform of a mechanical vibration at the actual volume flow by at least one electronic sensor in direct contact with the gas purging plug, whereas the electronic sensor is an acceleration sensor, preferably a piezoelectric acceleration sensor;

Calculating at least one bubble index component from the acquired (measured) oscillation waveform of a mechanical vibration at the actual volume flow;

Storing at least one value of the bubble index component (as a reference bubble index component), e.g., in the memory of a computer.

Figure 2:
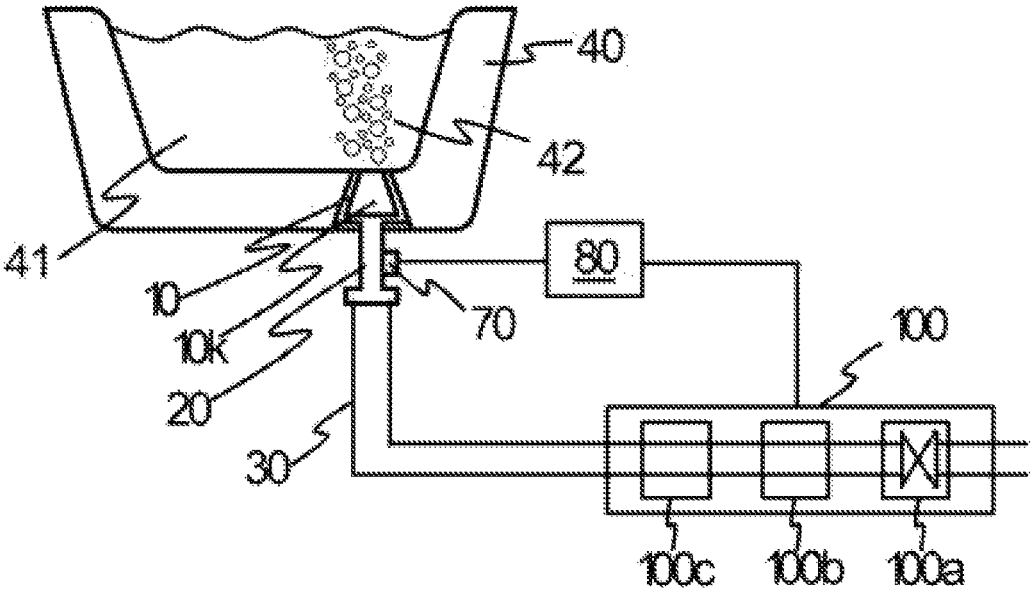
Figure 3:
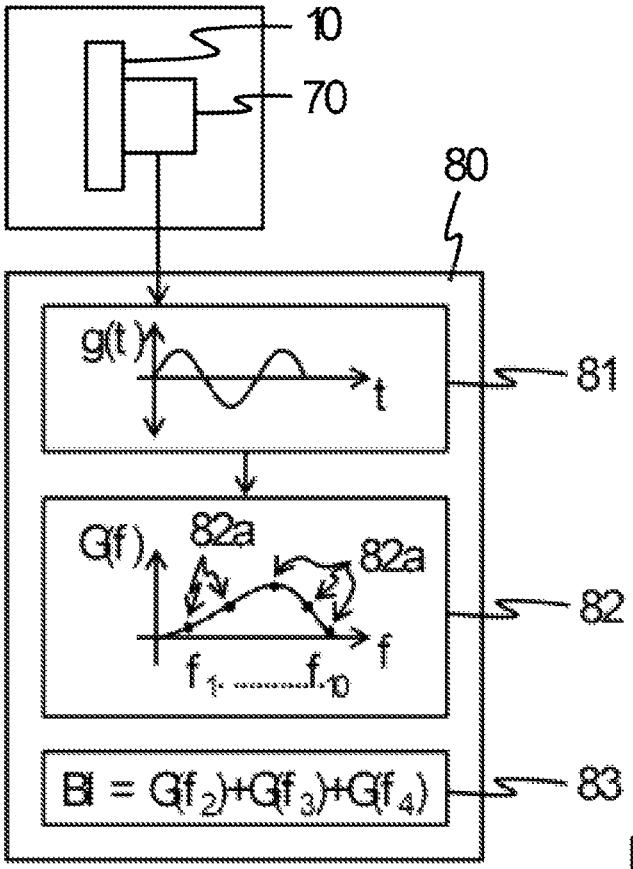
Figure 4:
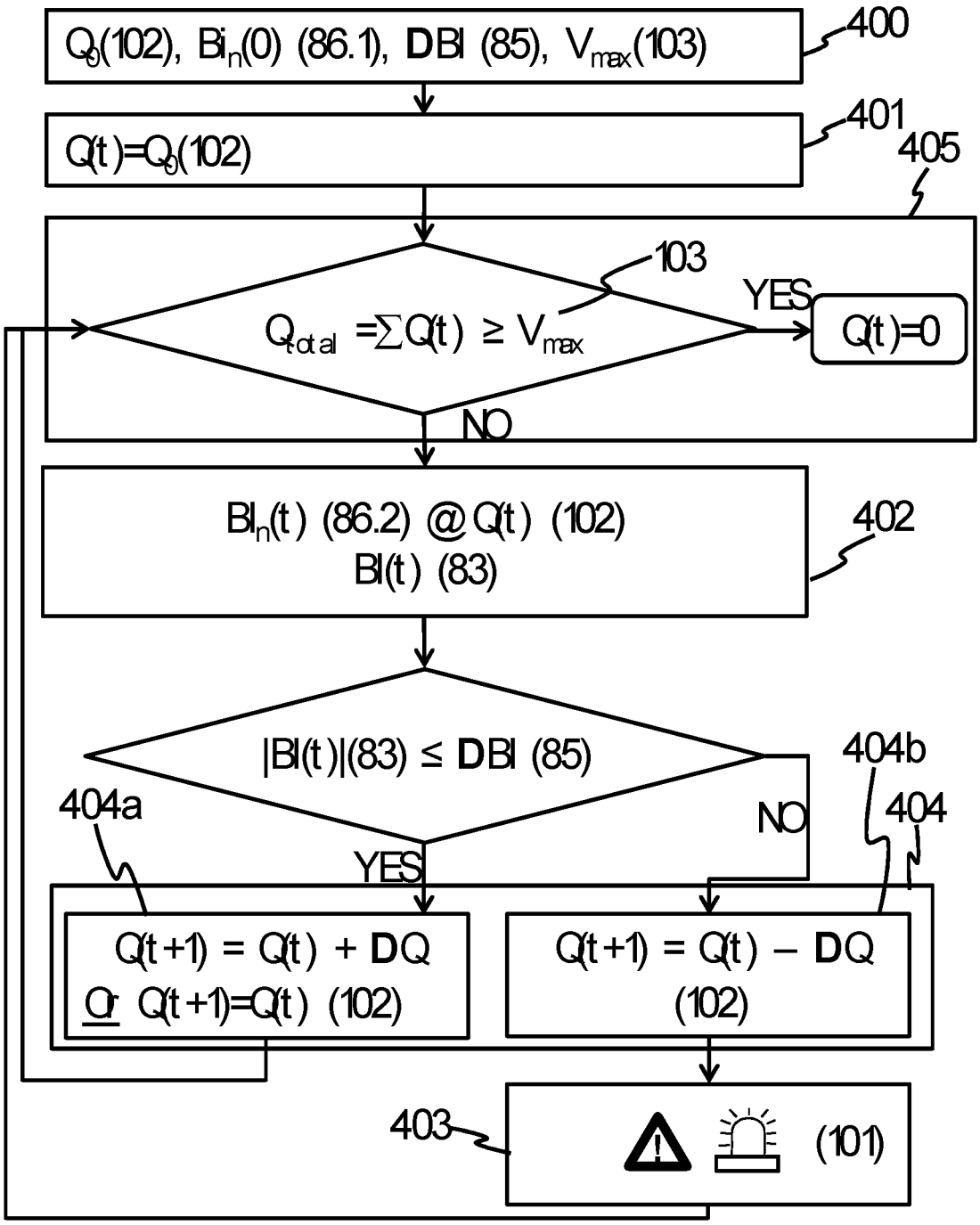
Figure 5:
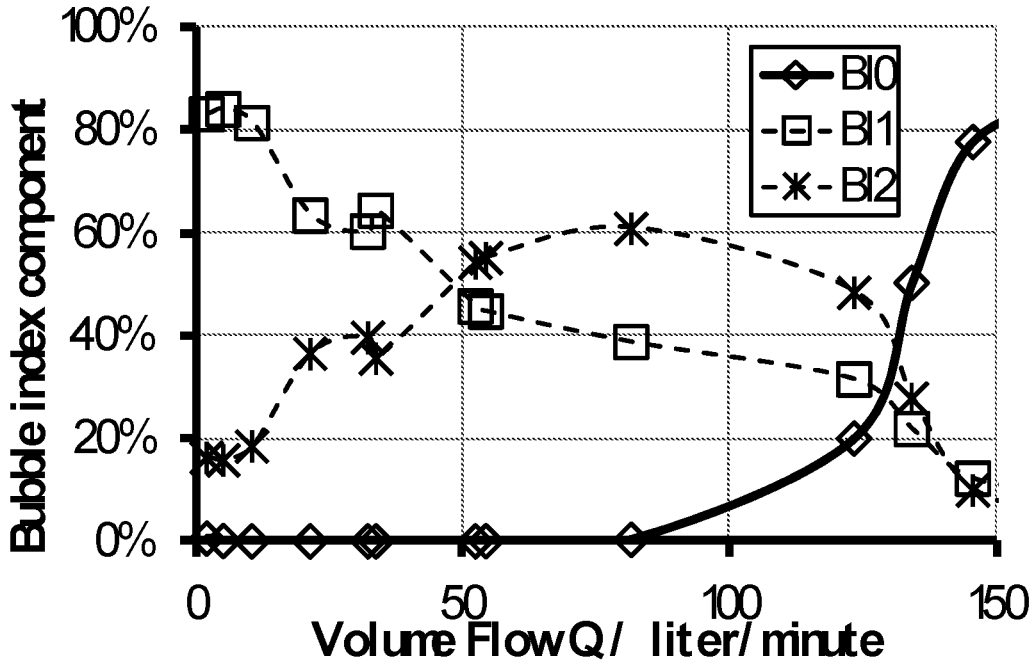
Figure 6:
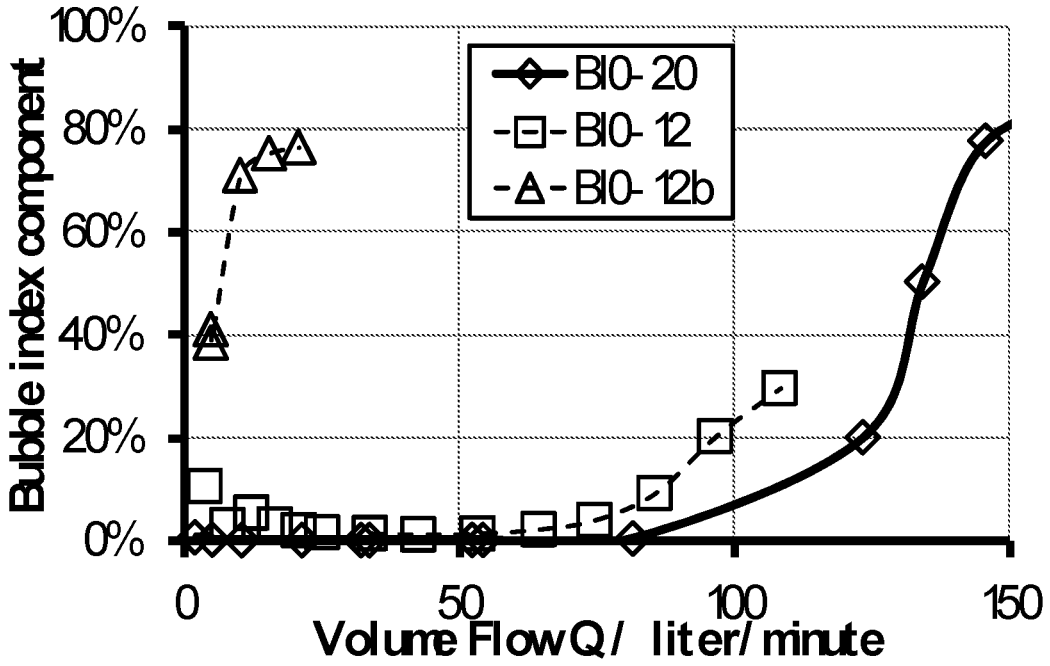

Exemplary embodiments of the invention are explained in more detail by means of illustrations:

FIG. 1 shows a schematic representation of an embodiment of the gas purging plug according to the invention, FIG. 2 shows a schematic representation of an embodiment of the gas purging system according to the invention, FIG. 3 shows a schematic sequence of an embodiment of the method according to the invention, FIG. 4 shows a schematic sequence of an embodiment of the method according to the invention, FIGS. 5 and 6 show an exemplary diagram of bubble index components.

FIG. 1 shows a first embodiment of the invention, namely a purging plug (10) for metallurgic applications comprising a ceramic refractory body (10*k*) with a first end (10*u*) and a second end (10*o*), the second end (10*o*) is in the mounted position of the gas purging plug (10) in contact with a metal melt (41, not shown in FIG. 1), the first end (10*u*) is covered with a metal cover (12.1), the metal cover (12.1) comprises an opening (16) to which a gas supply adapter (20) is connected, the gas purging plug (10) is designed in such a way, that a purging (treatment) gas, which is supplied via the gas supply adapter (20) to the opening (16), flows through the body (10*k*) and exits the body at the second end (10*o*), and at least one electronic sensor (70, 70.1, 70.2, 70.3) in mechanical contact with the gas purging plug (10), to detect an oscillation of a mechanical vibration (here a piezoelectric acceleration sensor is used: ICP accelerometer, Model Number 352C33). Between the metal cover (12.1) and the first end (10*u*) of the body (10*k*) an optional hollow space (14) allows for a distribution of the purging (treatment) gas before the purging (treatment) gas enters the body (10*k*) via its first end (10*u*). An optional metal jacket (12.2) surrounds (at least partially) the body (10*k*), the metal jacket is connected to the metal cover (12.1) in a gas-tight way, e.g. by welding the metal jacket (12.2) and the metal cover (12.1) together.

In a first alternative embodiment the sensor (70, 70.1) is mounted on the outside of the metal cover (12.1). The sensor (70, 70.1) is configured to detect oscillations/accelerations of a mechanical vibration in a direction normal to the second end (10*o*) of the body (10*k*).

In a second alternative embodiment the sensor (70, 70.2) is mounted on the outside of the gas supply adapter (20). The sensor is integrated into a removable clamp (not shown) which can be attached to the gas supply adapter (20). The sensor (70, 70.2) is configured to detect oscillations/accelerations of a mechanical vibration in a direction normal to the second end (10*o*) of the body (10*k*).

In a third alternative embodiment the sensor (70, 70.3) is mounted on the inside of the gas supply adapter (20). The sensor (70, 70.3) is configured to detect oscillations/accelerations of a mechanical vibration in a direction normal to the second end (10*o*) of the body (10*k*).

In a fourth alternative embodiment the sensor (70, 70.4) is mounted on the inside of the metal cover (12.1). The sensor (70, 70.4) is configured to detect oscillations/accelerations of a mechanical vibration in a direction normal to the second end (10*o*) of the body (10*k*).

FIG. 2 shows a second embodiment of the invention, namely a gas purging system comprising a gas purging plug (10) for metallurgic applications and a gas supply pipe (30) connected to the gas purging plug (10) via the gas supply adapter (20). The gas purging plug (10) comprises a ceramic refractory body (10*k*) with a first end (10*u*) and a second end (10*o*), the second end (10*o*) is in the mounted position of the gas purging plug (10) in contact with a metal melt (41), the first end (10*u*) is covered with a metal cover (12.1), the metal cover (12.1) comprises an opening (16) to which a gas supply adapter (20) is connected, the gas purging plug (10) is designed in such a way, that a purging gas which is supplied via the gas supply pipe (30), via the gas supply adapter (20) to the opening (10) flows through the body (10*k*) and exits the body (10*k*) at the second end (10*o*), and with at least one electronic sensor (70, 70.1, 70.2, 70.3). The gas purging system further comprises a data processing unit (80) for acquiring the oscillation waveform of a mechanical vibration (81) detected by the electronic sensor (70, 70.1, 70.2, 70.3) of the gas purging plug (10) and for calculating a bubble index signal (83) from the oscillation waveform of a mechanical vibration (81). The gas purging system further comprises a control unit (100), wherein the control unit (100) is configured to display the bubble index signal (83) and to vary the volume flow (102) through the gas supply pipe (30) (and thereby through the body (10*k*) of the gas purging plug (10)), depending on the bubble index signal BI(t) (83).

Alternatively (shown in FIG. 4) a warning signal (101) can be generated when the bubble index signal BI(t) (83) lies outside a defined range ΔBI (85). During operation, the gas purging plug (10) is installed in a wall of a metallurgical vessel (40). A purging (treatment) gas is supplied from a gas reservoir (not shown) via the gas supply pipe (30), through the control valve (100*a*), the flow meter (100*b*) and the pressure gauge (100*c*) of the control unit (100) to the gas supply adapter (20) through the opening (16) to the gas purging plug (10), where the gas passes from the first end (10*u*) to the second end (10*o*) of the body (10*k*) into the metal melt (41). The gas bubbles inside the metal melt constitute the purging gas treatment (42). The sensor (70) detects oscillations of a mechanical vibration at the gas purging plug (10) by recording the structure borne vibrations generated when gas bubbles leave the body (10*k*) at its second end (10*o*) into the metal melt (41). As shown in FIG. 3 the sensor transmits the detected oscillation values (as an electronic signal) of a mechanical vibration to the data processing unit (80). The detected oscillation values of a mechanical vibration are digitalized by the data processing unit (80) and constitute the oscillation waveform g(t) of a mechanical vibration (81). A Fourier Transformation is performed, which transforms the oscillation waveform g(t) of a mechanical vibration (81) into a frequency spectrum (82) comprising frequency amplitude values G(f) (82*a*). Bubble index components $BI_n(t)$ can be calculated from the frequency amplitude values G(f) (82*a*) of the frequency spectrum (82), e.g. by summing frequency amplitude values (82*a*) over a certain frequency range, at a specific time. Thus the data processing unit (80) determines the bubble index components (86.1, 86.2) by summing frequency amplitude values (82*a*) from the frequency spectrum (82) over a defined frequency range.

In another embodiment the system can be used to perform the following method for characterization of a gas purging plug (10), comprising the following steps:

Setting the volume flow (300) of a gas through the purging plug (10), e.g. to a pre-determined value of the initial volume flow (102);

Acquiring an oscillation waveform of a mechanical vibration (81) at the actual volume flow (102);

Calculating at least one bubble index component (301) from the measured oscillation waveform of a mechanical vibration (81) at the actual volume flow (102);

Storing at least one value of the bubble index component (302) as a reference bubble index component (86.1).

In this way several values for the bubble index components (86.1) can be stored, e.g. as a function of the volume flow (102) through the gas purging plug (10). These values can be used later for reference. The values can be recorded e.g. during operation of the gas purging plug (10) in a water bath (not shown) or during operation in a metallurgical vessel (40) in a trial run/calibration run (in a setup as shown exemplary in FIG. 2).

In another embodiment shown in FIG. 4 the system can be used to perform the following method for purging a metal melt (41) in a metallurgical vessel (40) with a gas, comprising the steps of:

Loading predetermined values (400) for: reference bubble component $BI_n(0)$ (86.1), an initial volume flow $Q_0$ (102) through the gas supply pipe (30), a bubble index range ΔBI (85), a target gas volume $V_{MAX}$ (103).

Setting the volume flow (401) of a gas through the purging plug (10) to a pre-determined value of the initial volume flow $Q(t)=Q_0$ (102);

Calculating a bubble index signal (402) BI(t) (83) from the measured oscillation waveform g(t) of a mechanical vibration (81) at the actual volume flow Q(t) (102) by determining the bubble index-signal BI(t) (83), whereas the bubble index-signal BI(t) (83) is calculated from the weighted summation of the differences or quotients between the actual bubble index components $BI_n(t)$ (86.2) and the reference bubble index-components $BI_n(0)$ (86.1) and Variation of the volume flow (404) Q(t) (102) through the gas supply pipe (30) as a function of the bubble index signal BI(t) (83).

The variation of the volume flow (404) Q(t) (102) comprises:

increasing or keeping constant the volume flow (404*a*) Q(t) (102) through the gas supply pipe (30) in case the bubble index signal BI(t) (83) lies within a predefined bubble index range ΔBI (85), so when $|BI(t)|\leq\Delta BI$;

decreasing the volume flow (404*b*) QM (102) through the gas supply pipe (30) in case the bubble index signal BI(t) (83) lies outside a predefined bubble index range ΔBI (85), so when $|BI(t)|>\Delta BI$.

Alternatively/additionally it is possible to generate a warning signal (403) if the bubble index signal BI(t) (83) lies outside a predefined bubble index range ΔBI (85) (not shown in the figure), so when $|BI(t)|>\Delta BI$.

Additionally gas purging can be stopped (405), once the total volume flow ($Q_{total}=\Sigma Q(t)$ or $\int Q(t)$) reaches a predefined target gas volume $V_{MAX}$.

Exemplary results obtained from a purging plug with a porous body of 20 cm diameter in a water bath model are shown in FIG. 5. In this example, the following bubble index components $BI_n$ are calculated by a summation in a frequency range starting from a to b according to $BI_n=\overline{G}_n(t)=\Sigma_{j=a}^{b}G(t, f_j)$:

| | | |
|---|---|---|
| $BI_0$: a = 20 Hz | . . . | b = 1000 Hz |
| $BI_1$: a = 1000 Hz | . . . | b = 6000 Hz |
| $BI_2$: a = 6000 Hz | . . . | b = 8000 Hz |

FIG. 5 shows the bubble index components $BI_0$, $BI_1$, $BI_2$ as a function of the volume flow Q (measured in liter per minute (l/min)). $BI_0$ relates to large sized bubble, $BI_1$ relates to medium sized bubbles and $BI_2$ relates to small sized bubbles. The y-axis shows the relative contribution of the respective bubble index component $BI_n$ to the overall analyzed signal (in percent). Thus it can be seen that up to approximately a volume flow of 80 liters per minute the signal $BI_0$ is close to 0, thus the amount of large bubbles up to this volume flow is very low. Starting around 80 liters per minute volume flow the signal $BI_0$ rises, showing that from 80 liters per minute and above the contribution of large bubbles increases. For example the signal $BI_0$ reaches a contribution of around 20% at 120 liters per minute. From the signal $BI_2$ it can be seen that the signal relating to small bubbles is relatively constant and high in a range starting from around 50 liters per minute up to around 120 liters per minute. The signal $BI_1$ shows the contribution of medium sized bubbles, which is slightly and constantly decreasing in the range between 50 to 120 liters per minute. Overall it can be seen that this purging plug shows a good bubble distribution in the range between 50 to around 120 liters per minute of volume flow of a purging gas flowing through the body.

FIG. 6 shows a comparison of the signal $BI_0$ (a=20 Hz . . . b=1000 Hz) relating to different purging plugs. $BI_0$-20 shows the purging plug of FIG. 5, $BI_0$-12 shows a purging plug with a porous body of 12 cm diameter and $BI_0$-12*b* shows a purging plug with a porous body of 12 cm diameter with a less porous body (e.g. many blocked pores). As discussed for FIG. 5, the purging plug with the signal $BI_0$-20 shows a low signal arising from large bubbles up to around 120 liters per minute, where the signal $BI_0$-20 arising from large bubbles reaches 20% contribution. The purging plug with the signal $BI_0$-12 already reaches the same 20% contribution (arising from large bubbles) to the signal at a volume flow of around 85 liters per minute. Therefore, for this plug the range of volume flow for a good bubble distribution is reduced to 85 liter per minute compared to the purging plug of FIG. 5 with a range of up to 120 liter per minute. The purging plug with the signal $BI_0$-12*b* (less porosity/blocked pores) shows a high contribution arising from large bubbles already at very low volume flows (e.g. at a 5 liters per minute the contribution the signal arising from large bubbles already shows a contribution of about 40%). Therefore this plug does not show a good bubble distribution for any volume flow, the method will issue a warning signal (101), e.g. requiring replacement of the purging plug (10).

A simple implementation of the method according to the invention could be as shown in the following example:

Loading predetermined values (400) for: reference bubble component $BI_0(0)=0$ (86.1) (e.g. the target is to have no or at least a low contribution of large sized bubbles, $BI_0$: a=20 Hz . . . b=1000 Hz), an initial volume flow $Q_0=80$ liters per minute (102) through the gas supply pipe (30), a bubble index range ΔBI=20% (85), a target gas volume $V_{MAX}=1200$ liter (103).

Setting the volume flow (401) of a gas through the purging plug (10) to a pre-determined value of the initial volume flow $Q(t)=Q_0=80$ liter per minute (102);

Calculating a bubble index signal (402) according to $BI(t)=BI_0(t)-BI_0(0)=BI_0(t)$ (83) from the measured oscillation waveform g(t) of a mechanical vibration (81) at the actual volume flow Q(t) (102) by determining the bubble index-signal BI(t) (83), whereas the bubble index-signal BI(t) (83) is calculated from the weighted summation of the differences or quotients between the actual bubble index components $BI_0(t)$ (86.2) and the reference bubble index-components $BI_0(0)=0$ (86.1) and Variation of the volume flow (404) Q(t) (102) through the gas supply pipe (30) as a function of the bubble index signal BI(t) (83).

The variation of the volume flow (404) Q(t) (102) comprises:

increasing the volume flow (404*a*) Q(t) (102) through the gas supply pipe (30) up to Q(t)=120 liter per minute where the bubble index signal BI(t) (83) lies within a predefined bubble index range ΔBI=20%, so until $|BI(t)|\leq\Delta BI$ (85) is fulfilled and stopping the gas purging (405), when the total volume flow $Q_{total}=\Sigma Q(t)$ (102) through the pipe (30) reaches a predefined target gas volume $V_{MAX}=1200$ liters (102), which is achieved at a little more than 10 minutes of gas purging. In a second example the same values are used as in the previous example, with the exception that the initial volume flow is loaded to be $Q_0=150$ liters per minute (102). Now the variation of the volume flow (404) Q(t) (102) comprises:

decreasing the volume flow (404*b*) Q(t) (102) through the gas supply pipe (30) as long as the bubble index signal BI(t) (83) lies outside a predefined bubble index range ΔBI=20%

(85), so as long as |BI(t)|>ΔBI, which is until the volume flow is reduced to Q(t)=120 liter per minute.

stopping the gas purging (405), when the total volume flow $Q_{total}=\Sigma Q(t)$ (102) through the pipe (30) reaches a predefined target gas volume $V_{MAX}=1200$ liters (102), which is achieved at a little less than 10 minutes.

In case the purging plug used in the examples degrades during purging, e.g. in a case where the signal $BI_0$ increases at an actual volume flow (e.g. at 120 liters per minute as in the examples), the method according to the invention will reduce the volume flow until the same contribution of $BI_0$ is reached again, but at a lower volume flow. In such a case the purging time will be increased until the target gas volume is reached. Thereby the method allows to maintain constant gas bubble distributions over the whole duration of the purging process with a pre-defined overall target gas volume.

List of reference numerals and factors (German translation in parenthesis):

Gas purging plug (Gasspül-Element)

10*k* Ceramic refractory body (keramischer feuerfester Körper)

10*u* First end of ceramic refractory body

10*o* Second end of ceramic refractory body

12.1 Metal cover (Metalldeckel)

12.2 Metal jacket (Metallmantel)

14 Hollow space (Hohlraum)

16 Opening (Öffnung)

20 Gas supply adapter (Gasanschlussstutzen)

30 Gas supply pipe (Gaszuführ-Leitung)

40 Metallurgical vessel

41 Metal melt

42 Purging gas treatment

70 Sensor (Sensor)

70.1 Sensor mounted outside of metal coat

70.2 Sensor mounted outside of gas supply adapter

70.3 Sensor mounted inside of gas supply adapter

70.4 Sensor mounted inside of metal coat

80 Data processing unit

81 Oscillation waveform g(t) of a mechanical vibration

82 Frequency spectrum

82*a* Frequency amplitude values G(t, f)

83 Bubble index signal BI(t)

85 Bubble index range ΔBI

86.1 Reference bubble index components $BI_n(0)$

86.2 Actual bubble index components $BI_n(t)$

100 Control unit

100*a* Control valve

100*b* Flow meter

100*c* Pressure gauge

101 Warning signal

102 Volume flow Q(t)

103 Target gas volume VMAX

300 Setting the volume flow

301 Calculating at least one bubble index component (86.1)

302 Storing at least one value of the bubble index component (86.1)

400 Determining predetermined values

401 Setting the volume flow (102)

402 Calculating a bubble index signal (83)

403 Generating a warning signal (101)

404 Variation of the volume flow (102)

404*a* Increasing or keeping constant the volume flow (102)

404*b* Decreasing the volume flow (102)

405 Stopping the gas purging

The invention claimed is:

1. Gas purging plug (10) for metallurgic applications comprising a.) a ceramic refractory body (10*k*) with a first end (10*u*) and a second end (10*o*);

b.) the second end (10*o*) is in a mounted position of the gas purging plug (10) that is in contact with a metal melt (41);

c.) the first end (10*u*) is at least partially covered with a metal cover (12.1), the metal cover (12.1) comprises an opening (16) to which optionally a gas supply adapter (20) is connected;

d.) the gas purging plug (10) is designed in such a way, that a purging gas, which is supplied via the opening (16), flows through the body (10*k*) and exits the body (10*k*) at the second end (10*o*);

e.) and at least one electronic sensor (70, 70.1, 70.2, 70.3, 70.4) in direct contact with the gas purging plug (10), to detect an oscillation waveform of a mechanical vibration (81), whereas the electronic sensor (70, 70.1, 70.2, 70.3, 70.4) is an acceleration sensor.

2. Gas purging plug (10) for metallurgic applications according to claim 1, whereas the at least one electronic sensor (70, 70.1, 70.2, 70.3, 70.4) is mounted on the metal cover (12.1) or on the gas supply adapter (20) of the gas purging plug (10).

3. Gas purging plug (10) for metallurgic applications according to claim 1, whereas the electronic sensor (70, 70.1, 70.2, 70.3, 70.4) is a piezoelectric acceleration sensor (70, 70.1, 70.2, 70.3, 70.4).

4. Gas purging system comprising a gas purging plug (10) for metallurgic applications and a gas supply pipe (30) connected to the gas purging plug (10), the gas purging plug (10) comprising:

a.) a ceramic refractory body (10*k*) with a first end (10*u*) and a second end (10*o*);

b.) the second end (10*o*) is in a mounted position of the gas purging plug that is in contact with a metal melt;

c.) the first end (10*u*) is at least partially covered with a metal cover (12.1), the metal cover (12.1) comprises an opening (16) to which optionally a gas supply adapter (20) is connected;

d.) the gas purging plug (10) is designed in such a way, that a purging gas which is supplied via the gas supply pipe (30) to the opening (16) flows through the body (10*k*) and exits the body (10*k*) at the second end (10*o*);

e.) and wherein at least one electronic sensor (70, 70.1, 70.2, 70.3, 70.4) is in direct contact with the gas purging plug (10), to detect an oscillation waveform of a mechanical vibration (81), whereas the electronic sensor (70, 70.1, 70.2, 70.3, 70.4) is an acceleration sensor;

the gas purging system further comprises:

f.) a data processing unit (80) for acquiring the oscillation waveform of a mechanical vibration (81) detected by the electronic sensor (70, 70.1, 70.2, 70.3, 70.4) of the gas purging plug (10) and for calculating a bubble index-signal (83) from the oscillation waveform of a mechanical vibration (81) detected;

g.) a control unit (100);

wherein the control unit (100) is configured to:

display the bubble index-signal (83); and/or vary the volume flow (102) through the gas supply pipe (30) depending on the bubble index signal (83); and/or generate a warning signal (101) when the bubble index signal (83) lies outside a defined range.

5. Gas purging system according to claim 4, further comprising at least one of the following components, connected to the control unit (100):

a control valve (100*a*) to control the volume flow (102) through the gas supply pipe (30);

a flow meter (100*b*) to measure the volume flow (102) through the gas supply pipe (30);

optionally a pressure gauge (100*c*) to measure the pressure in the gas supply pipe (30).

6. Gas purging system according to claim 4, whereas the data processing unit (80) determines at least one bubble index component (86.1, 86.2) by summing frequency amplitude values (82*a*) from the frequency spectrum (82) over a defined frequency range.

7. Gas purging system according to claim 4, whereas the data processing unit (80) determines the bubble index signal (83) from the summation of the differences or quotients between at least one of actual bubble index components (86.2) and at least one of reference bubble index components (86.1).

8. Method for characterization of a gas purging plug (10), comprising the following steps:

Setting an actual volume flow (300) of a gas through the purging plug (10);

Acquiring an oscillation waveform of a mechanical vibration (81) at the actual volume flow (102) by at least one electronic sensor (70, 70.1, 70.2, 70.3, 70.4) in direct contact with the gas purging plug (10), whereas the electronic sensor (70, 70.1, 70.2, 70.3, 70.4) is a piezoelectric acceleration sensor;

Calculating at least one bubble index component (301) from the acquired oscillation waveform of a mechanical vibration (81) at the actual volume flow (102);

Storing at least one bubble index component (302).

9. Method for purging a metal melt (41) in a metallurgical vessel (40) with a gas, comprising the steps of:

Setting an actual volume flow (401) of a gas through a purging plug (10) to a pre-determined value of an initial volume flow (102);

Acquiring an oscillation waveform of a mechanical vibration (81) at the actual volume flow (102) by at least one electronic sensor (70, 70.1, 70.2, 70.3, 70.4) in direct contact with the gas purging plug (10), whereas the electronic sensor (70, 70.1, 70.2, 70.3, 70.4) is an acceleration sensor; and:

Varying the volume flow (404) through the gas supply pipe (30) depending on the acquired oscillation waveform of the mechanical vibration (81); and/or Generating a warning signal (403) depending on the acquired oscillation waveform of the mechanical vibration (81).

10. Method for purging a metal melt (41) in a metallurgical vessel (40) with a gas according to claim 9, comprising the steps of:

Calculating a bubble index signal (402) from the acquired oscillation waveform of a mechanical vibration (81) at the actual volume flow (102); and:

Generating a warning signal (403) if the bubble index signal (83) lies outside a predefined bubble index range (85), and/or Varying the volume flow (404) through the gas supply pipe (30) as a function of the bubble index signal (83).

11. Method for purging a metal melt (41) in a metallurgical vessel (40) with a gas according to claim 9, whereas before the step of setting the volume flow (401), a step of determining predetermined values (400) for at least one of the values of the following groups is performed: a reference bubble index component (86.1), the initial volume flow (102) through the gas supply pipe (30), a bubble index range (85), a target gas volume (103).

12. Method for purging a metal melt (41) in a metallurgical vessel (40) with a gas according to claim 10, whereas the step of calculating a bubble index signal (402) comprises that the bubble index signal (83) is calculated from the weighted summation of the differences or quotients between the actual bubble index components (86.2) and the reference bubble index components (86.1).

13. Method for purging a metal melt (41) in a metallurgical vessel (40) with a gas according to claim 10, whereas the step of varying the volume flow (404) comprises:

increasing or keeping constant the volume flow (404*a*) through the gas supply pipe (30) in case the bubble index signal (83) lies within a predefined bubble index range (85); and decreasing the volume flow (404*b*) through the gas supply pipe (30) in case the bubble index signal (83) lies outside a predefined bubble index range (85).

14. Method for purging a metal melt (41) in a metallurgical vessel (40) with a gas according to claim 9, wherein the gas purging plug comprises:

a.) a ceramic refractory body (10*k*) with a first end (10*u*) and a second end (10*o*);

b.) the second end (10*o*) is in the mounted position of the gas purging plug (10) in contact with the metal melt (41);

c.) the first end (10*u*) is at least partially covered with a metal cover (12.1), the metal cover (12.1) comprises an opening (16) to which optionally a gas supply adapter (20) is connected;

d.) the gas purging plug (10) is designed in such a way, that the gas, which is supplied via the opening (16), flows through the body (10*k*) and exits the body (10*k*) at the second end (10*o*);

e.) and at least one electronic sensor (70, 70.1, 70.2, 70.3, 70.4) in direct contact with the gas purging plug (10), to detect an oscillation waveform of a mechanical vibration (81), whereas the electronic sensor (70, 70.1, 70.2, 70.3, 70.4) is an acceleration sensor.

* * * * *